US005775596A

United States Patent [19]

Whisman et al.

[11] Patent Number: 5,775,596

[45] Date of Patent: Jul. 7, 1998

[54] FOAM GENERATING NOZZLE

[75] Inventors: Daniel Bruce Whisman; Kevin James Petit, both of Wooster, Ohio

[73] Assignee: Premier Farnell Corp., Cleveland, Ohio

[21] Appl. No.: 634,601

[22] Filed: Apr. 18, 1996

[51] Int. Cl.[6] ..... E03C 1/08

[52] U.S. Cl. ..... 239/428.5; 239/432; 239/416.5; 169/15

[58] Field of Search ..... 239/405, 406, 239/416.5, 399, 432, 428.5, 343, DIG. 1, 590, 590.3, 590.5; 169/15

[56] References Cited

U.S. PATENT DOCUMENTS

| | | | |
|---|---|---|---|
| 2,665,943 | 1/1954 | Palm | 239/428.5 |
| 3,094,171 | 6/1963 | Gagliardo | 239/399 |
| 3,138,332 | 6/1964 | Hinderer | 239/428.5 |
| 3,388,868 | 6/1968 | Watson et al. | 169/15 |
| 3,863,844 | 2/1975 | McMillan | 239/590.5 |
| 3,918,647 | 11/1975 | Lamz et al. | 239/428.5 |
| 4,143,717 | 3/1979 | Gagliardo et al. | 169/15 |
| 4,640,461 | 2/1987 | Williams | 239/432 |
| 4,869,103 | 9/1989 | Jerman | 239/428.5 |
| 4,991,779 | 2/1991 | Blake, III | 239/432 |
| 5,058,809 | 10/1991 | Carroll et al. | 239/428.5 |
| 5,472,145 | 12/1995 | Shannon et al. | 239/590.5 |
| 5,495,985 | 3/1996 | Nehm et al. | 239/428.5 |

*Primary Examiner*—Andres Kashnikow
*Assistant Examiner*—Lisa Ann Douglas
*Attorney, Agent, or Firm*—Jones, Day, Reavis & Pogue

[57] ABSTRACT

Plural liquid streams supplied to a foam tube of a nozzle include an outer hollow cylindrical stream surrounding a plurality of spaced-apart inner streams for enhancing mixture of air and liquid in the foam tube.

20 Claims, 4 Drawing Sheets

FOAM GENERATING NOZZLE

BACKGROUND OF THE INVENTION

This application relates to the art of nozzles and, more particularly, to nozzles that generate foam for use in fire fighting. Although the invention will be described with specific reference to a particular type of nozzle, it will be appreciated that features of the invention have broader aspects and can be used in other types of nozzles.

The National Fire Protection Association ("NFPA") publishes standards for fire fighting foam equipment. NFPA 412 and 414 include requirements relating to foam expansion, drain time and reach. Foam expansion is the ratio between the volume of foam produced and the volume of solution used in its production, and depends upon the amount of air that is mixed with the foam concentrate. Drain time concerns the amount of time it takes for the foam to break down after it has been applied to a surface. Insufficient air will cause the foam to break down too rapidly. Reach concerns the distance that the foam concentrate can be projected from the nozzle at a given flow rate and pressure. Foam concentrate with excessive air will be too light and fluffy, and will not be capable of achieving the necessary reach. Foam concentrate that has insufficient air will easily satisfy the reach requirement but will not satisfy the foam expansion and drain time requirements. It is difficult to satisfy all of these conflicting requirements in a nozzle that is relatively simple and economical to manufacture.

One proposed arrangement for enhancing mixture of air with a foam concentrate is disclosed in U.S. Pat. No. 4,143,717 issued Mar. 13, 1979. This patent discloses an arrangement for dividing one foam concentrate stream into a plurality of smaller streams that include one rather large solid central stream that is outwardly surrounded by a plurality of spaced-apart much smaller streams. This design has a foam tube that includes concentric inner and outer foam tubes. The solid central stream flows through the inner foam tube and the smaller streams flow through the space between the inner and outer foam tubes. Thus, the central stream and the smaller streams are not agitated and mixed together in the foam tube. Also, the solid central stream and the outer smaller streams do not significantly increase the total outer surface area of the one foam concentrate stream. It would be desirable to have an arrangement for enhancing turbulence within a foam tube for mixing the foam concentrate with air, and to have an arrangement for significantly increasing the outer surface area of the foam concentrate liquid that is exposed to air.

SUMMARY OF THE INVENTION

A nozzle of the type described has a stream divider for dividing one large volume liquid stream into a plurality of small volume liquid streams that include an outer cylindrical hollow stream surrounding a plurality of spaced-apart inner streams. The hollow cylindrical stream has both inner and outer surface areas that significantly increase the surface area of liquid that is exposed to air.

In one arrangement, the longitudinal axes of the inner streams extend substantially parallel to the longitudinal axis of the outer cylindrical hollow stream. In another arrangement, the longitudinal axis of each inner stream is inclined outwardly away from the longitudinal axis of the outer cylindrical hollow stream so that the inner streams intersect the hollow stream. This increases the turbulence between the streams in the foam tube to better enhance the mixing of air with the solution of foam and water.

In accordance with one aspect of the invention, both the inner and outer diameters of the cylindrical hollow stream are greater than the diameter of the one large volume liquid stream. This is achieved by providing an outwardly flaring outlet for the cylindrical flow passage through which the large volume liquid stream flows, and by providing a circular stream divider baffle in the outlet that has a diameter larger than the diameter of the flow passage for the large volume liquid stream.

In a preferred arrangement, the outer hollow cylindrical stream strikes the inner surface of the foam tube downstream from the foam tube inlet for creating significant turbulence within the foam tube to enhance aspiration and mixing of air.

In one arrangement, the nozzle has a cylindrical inner periphery through which the large volume liquid stream flows and the stream divider comprises a circular baffle that has an outer periphery spaced inwardly from the inner periphery of the nozzle outlet to define an annular passage that forms the cylindrical hollow stream. The baffle has a plurality of spaced-apart circular inner passages spaced inwardly from its outer periphery for providing formation of the plurality of spaced-apart solid cylindrical inner streams.

In accordance with another aspect of the invention, the baffle is secured within the nozzle by a baffle holder that extends along the longitudinal axis of the nozzle on the upstream side of the baffle.

In a preferred arrangement, the upstream surface of the baffle includes a central hub that has a smooth concave curvature extending along a portion of the hub length and then outwardly toward the baffle outer periphery. This minimizes turbulent flow and excessive head loss before the stream is divided.

Another aspect of the invention concerns a cylindrical flow passage for one large volume liquid stream that flares outwardly to its outlet. The circular stream divider baffle is positioned in the outlet and has a diameter larger than the diameter of the cylindrical flow passage for the one large volume liquid stream but smaller than the diameter of the outlet. The hollow cylindrical stream is formed around the outer periphery of the baffle.

The hollow cylindrical stream is directed into a foam tube that has an entrance opening diameter larger than the outer diameter of the hollow cylindrical stream and has an outlet opening diameter that is smaller than the outer diameter of the hollow cylindrical stream.

The enhanced performance of a nozzle having the improved arrangements of the present application makes it possible to significantly reduce the length of the foam tube. In a preferred arrangement, the total length of the foaming chamber from the downstream surface of the stream divider baffle to the foam tube outlet is not greater than about 16 inches. This makes it possible to significantly reduce both the weight and size of the nozzle.

It is a principal object of the present invention to provide a nozzle that has enhanced foam forming capability.

It is also an object of the invention to provide a nozzle that satisfies NFPA 412 and 414 while being of much smaller size and weight.

It is a further object of the invention to provide a nozzle with a stream divider in a manner that is relatively simple and makes the nozzle relatively economical to manufacture.

It is an additional object of the invention to provide an improved method for enhancing the mixture of air and a foam concentrate in a nozzle used for fire fighting.

DESCRIPTION OF A PREFERRED EMBODIMENT

Figure 1:
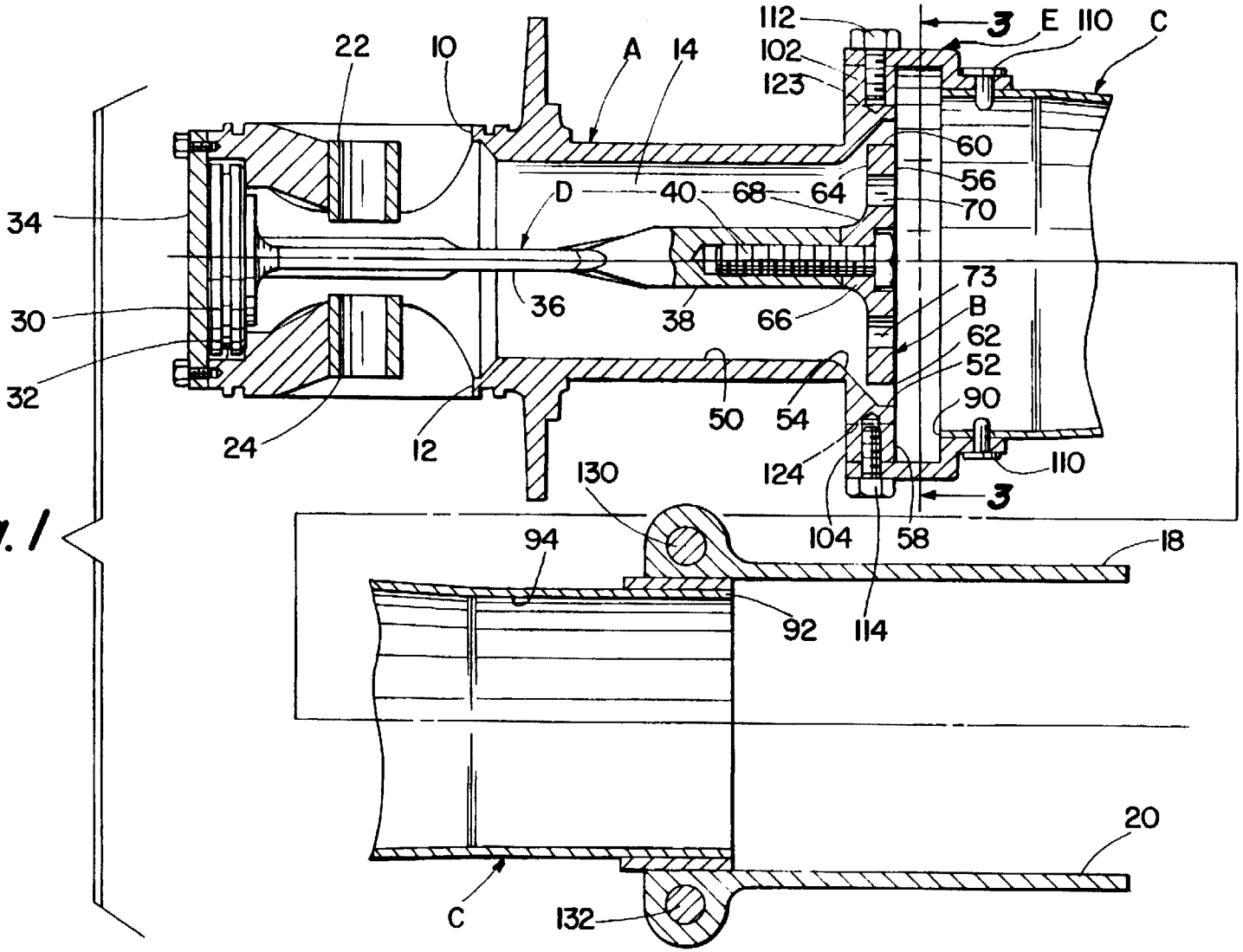
FIG. 1 is a cross-section elevational view of a nozzle constructed in accordance with the present application.
Figure 2:
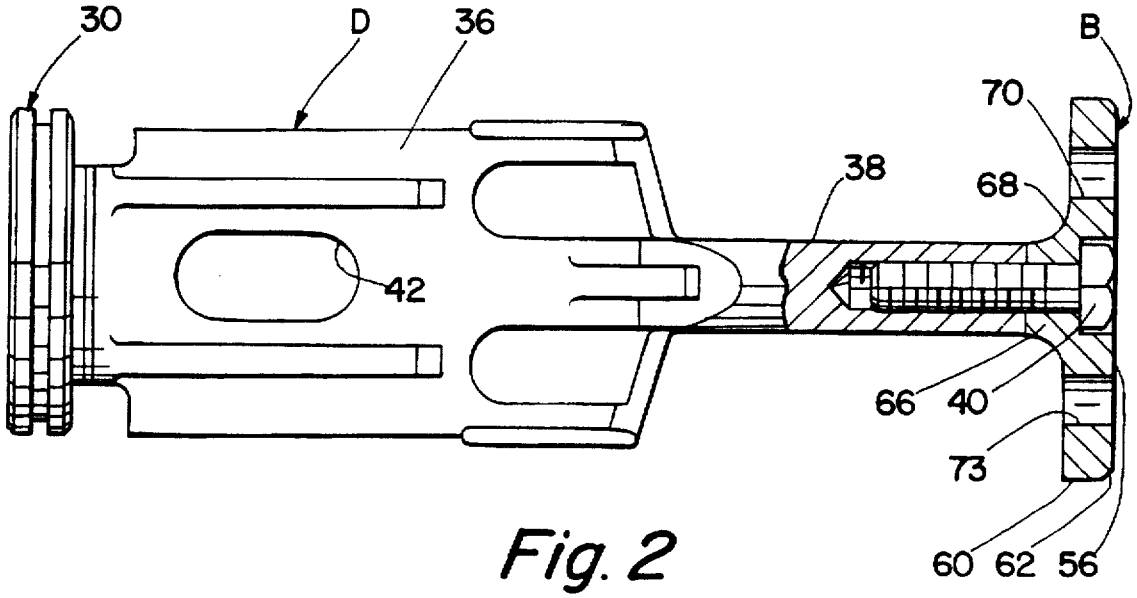
FIG. 2 is a side elevational view of a baffle holder taken at ninety degrees to the view of the baffle holder shown in FIG. 1.

Referring now to the drawing, wherein the showings are for purposes of illustrating a preferred embodiment of the invention only and not for purposes of limiting same, FIG. 1 shows a nozzle having a tee A with liquid inlets 10,12 through which a liquid enters cylindrical passage 14 and flows to the right past stream divider baffle B and through foam tube C to discharge between pattern blades 18,20. The streams are agitated and mixed with air in the foam tube prior to discharge.

Couplings are attached to inlets 10,12 in a known manner and bushings 22,24 receive a bolt that is used for attaching the couplings. A baffle holder D has a cylindrical piston 30 closely received in a recess 32 in tee A and the recess is closed by a coverplate 34. Baffle holder D has a flat portion 36 extending between piston 30 and a central cylindrical portion 38 to which baffle B is attached by a bolt 40. Flat portion 36 of baffle holder D has an opening 42 therethrough for permitting passage of the bolt that extends through bushings 22,24 for attaching liquid inlet couplings to tee A. Liquid entering inlets 10,12 strikes the opposite flat surfaces of flat portion 36 of baffle holder D and the liquid then flows to the right along cylindrical portion 38 of baffle holder D.

Passage 14 in tee A has a cylindrical inner periphery 50 and is outwardly enlarged around baffle B to a much larger diameter at its circular outlet 52. The transition between inner periphery 50 and outlet 52 is smoothly curved as shown in FIG. 1 to minimize turbulent flow. An outwardly flared surface 54 extends between cylindrical inner periphery 50 and outlet 52. Baffle B has a downstream surface 56 that is positioned adjacent end surface 58 of tee A at outlet 52. The intersection between baffle downstream surface 56 and baffle cylindrical outer periphery 60 is chamfered as indicated at 62. Upstream surface 64 of baffle B includes an elongated central cylindrical hub 66 that terminates at a hub end having approximately the same size and shape as the end of cylindrical stem portion 38 of baffle holder D. The outer surface of hub 66 is smoothly concavely curved axially of hub 66 and then outwardly toward baffle outer periphery 60. The smooth outward concave curvature is generally indicated at 68. Baffle B has six small circular holes 70–75 spaced inwardly from baffle outer periphery 60 and outwardly from the center of baffle B. The longitudinal axes of holes 70–75 extend substantially parallel to the longitudinal axis of baffle B.

Figure 4:
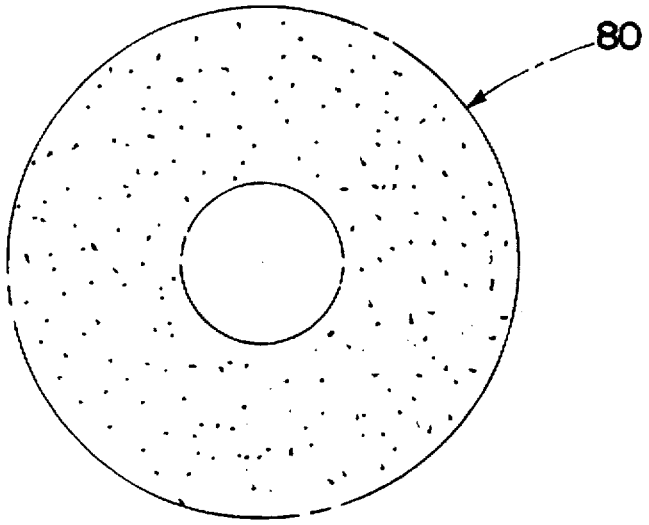
FIG. 4 is a cross-sectional elevational view of the liquid stream before it is divided.
Figure 5:
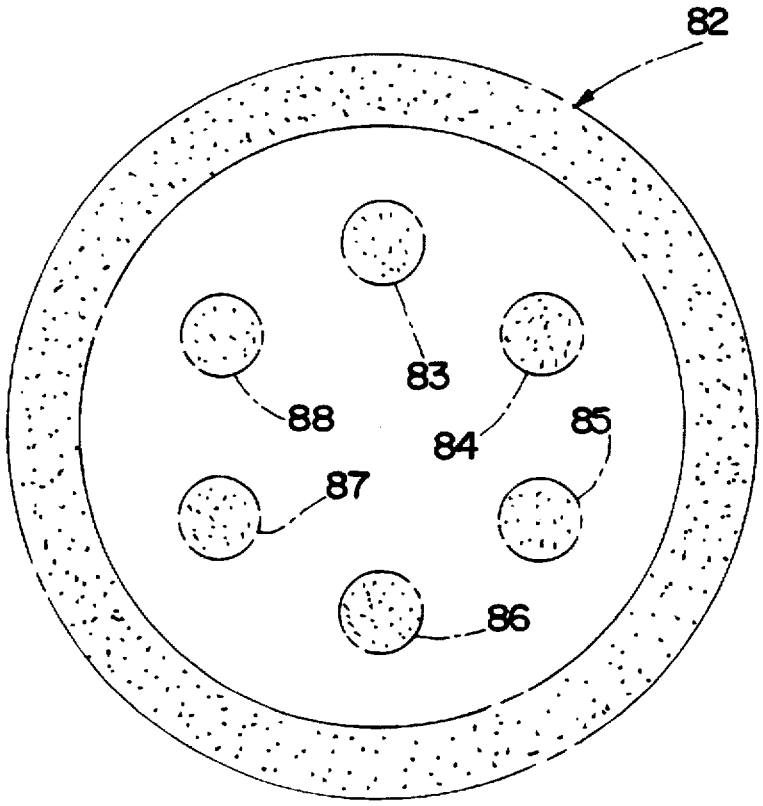
FIG. 5 is a cross-sectional elevational view showing the stream of FIG. 4 after it has been divided into an outer cylindrical hollow stream surrounding a plurality spaced-apart solid cylindrical inner streams.

The single liquid stream flowing through passage 14 in tee A has the shape generally indicated at 80 in FIG. 4. Upon reaching baffle B, the liquid expands outwardly along flared passage surface 54 and flows past the outer periphery 60 of baffle B through outlet 52. Liquid also flows through holes 70–75 in baffle B. Thus, single liquid stream 80 is divided into a plurality of individual streams as shown in FIG. 5. The individual streams include an outer cylindrical hollow stream 82 that outwardly surrounds a plurality of spaced-apart solid cylindrical inner streams 83–88. Both the inner and outer diameters of cylindrical hollow stream 82 are greater than the outer diameter of single liquid stream 80. The longitudinal axes of inner streams 83–88 extend substantially parallel to the longitudinal axis of outer cylindrical hollow stream 82.

The intersection between baffle upstream surface 64 and baffle outer periphery 60 is a circular sharp edge that is spaced from outwardly flared surface 54 of tee A to provide a narrow annular passage leading to outlet 52. As shown in FIG. 1, this passage is much narrower than the annular passage between baffle outer periphery 60 and outlet 52 so that the liquid foam concentrate is allowed to expand as it moves past the upstream circular sharp edge of the baffle.

The central axis of baffle B is coincidental with the longitudinal axis of cylindrical passage 14. The longitudinal axis of baffle holder D is also coincidental with the longitudinal axis of the nozzle and passage 14.

Foam tube C converges from its circular inlet 90 toward its circular outlet 92 so that its inner periphery lies on the surface of a cone. At its entrance end 90, the diameter of foam tube C is substantially larger than the outer diameter of outer cylindrical hollow stream 82. Therefore, all of the individual streams freely enter foam tube C at its inlet 90 without contacting the inner surface of the foam tube. Approximately half way through foam tube C, the inner diameter of foam tube C becomes smaller than the outer diameter of outer cylindrical hollow stream 82. This stream strikes the inner surface of foam tube C and the turbulent flow created also disrupts the flow of small inner streams 83–88. The turbulent mixture of all the streams causes the foam concentrate to completely fill the cylindrical outlet portion 94 of foam tube C.

Figure 3:
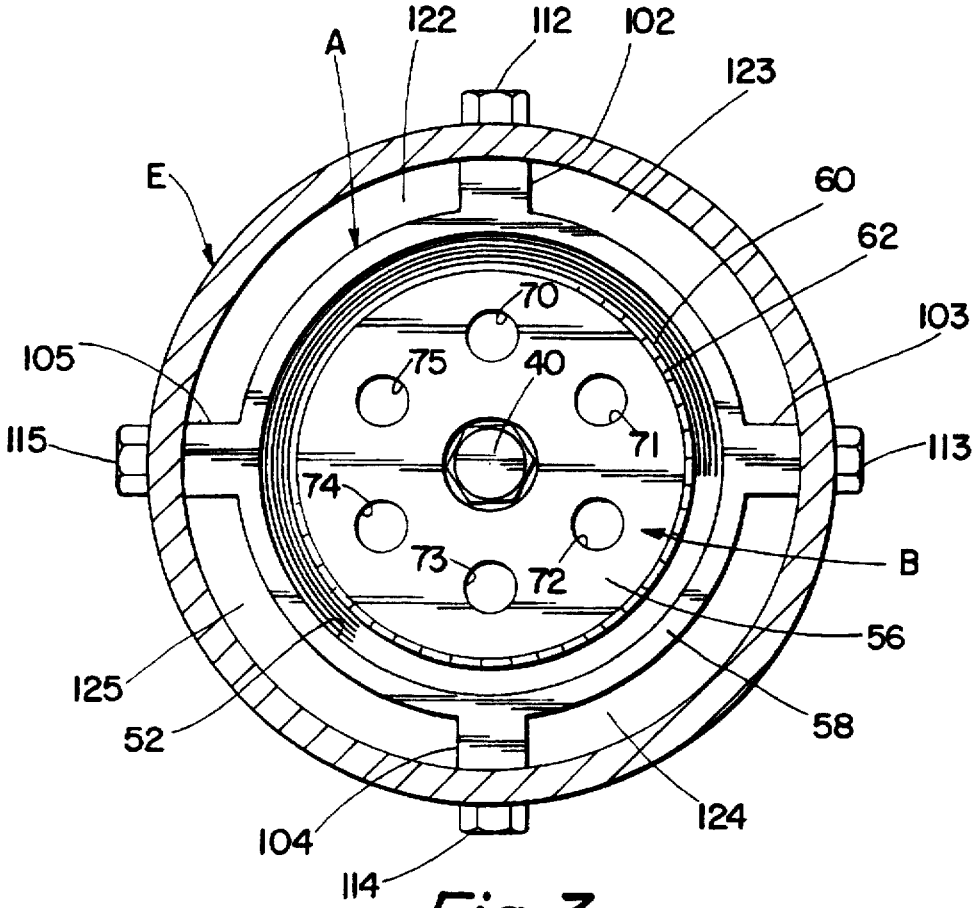
FIG. 3 is a cross-sectional elevational view taken generally on line 3—3 of FIG. 1.

With reference to FIG. 3, the outlet end portion of tee A has four circumferentially-spaced outwardly extending bosses 102–105 thereon. A generally cylindrical collar E that is suitably attached to the inlet end portion of foam tube C as by rivets 110 is received over bosses 102–105 and attached thereto by bolts 112–115. The arcuate openings between bosses 102–105 beneath collar E define air inlet openings 122–125 through which air is aspirated into the interior of foam tube C through inlet 90. The liquid foam concentrate flowing through foam tube outlet portion 94 creates a vacuum within foam tube C that aspirates air through passages 122–125 for mixture with streams 82–88 when the streams are agitated and mixed within foam tube C.

Pattern blades 18–20 are hinged to foam tube C as generally indicated at 130,132 in a known manner for guiding the foam as it is discharged from the foam tube. A conventional lever and linkage mechanism that is not shown is used for moving the pattern blades toward and away from one another.

The liquid used in a nozzle of the type described in the present application is an aqueous film forming foam concentrate. This is a concentrated aqueous solution of fluorinated surfactants and foam stabilizers capable of producing an aqueous fluorocarbon film on the surface of hydrocarbon fuels to suppress vaporization.

One example of dimensions and dimensional relationships will be given by way of illustration and should not be taken in a limiting sense. It is obvious that variations in preferred dimensions and dimensional relationships can be made without departing from the spirit of the invention. The diameter of inner periphery 50 of passage 14 in tee A is about 2.75 inches. The diameter of outlet 52 is about 3.75 inches. The diameter of baffle B is about 3.15 inches. Baffle holes 70–75 have a diameter of about 0.375 inches and have centers lying on a circle with a diameter of about 1.875 inches and having a center coincidental with the central axis of baffle B. Baffle hub 66 has an axial length of about 0.325 inches and baffle B has a thickness between its downstream and upstream surfaces 56, 64 of about 0.375. Hub 66 has a terminal flat circular end with a diameter of about 0.810 inches. Foam tube C has an axial length from its inlet end 90 to its outlet end 92 of about 12.5 inches and converges at about a three degree slope from its inlet end toward its outlet end. Foam tube C has an inner diameter at its inlet end 90 of about 4.325 inches and an inner diameter at its outlet end 92 of about 3.675 inches. Cylindrical portion 94 of foam tube C has a length of about 3.5 inches. The dimensions of collar E are such that the collar adds about 0.625 inch to the distance from downstream surface 56 of baffle B to outlet end 92 of foam tube C. This total distance from the downstream surface 56 of baffle B to outlet end 92 of form tube C is then about 13.125 inches. Preferably, this distance is less than about 16 inches, more preferably less than about 15 inches and most preferably not greater than about 13.5 inches.

Figure 6:
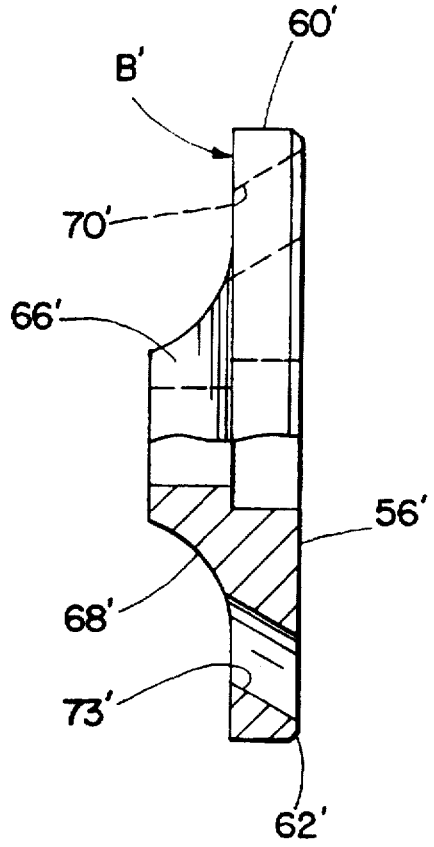
FIG. 6 is a side elevational view of another baffle and with the bottom half of the Figure in section for clarity of illustration.
Figure 7:
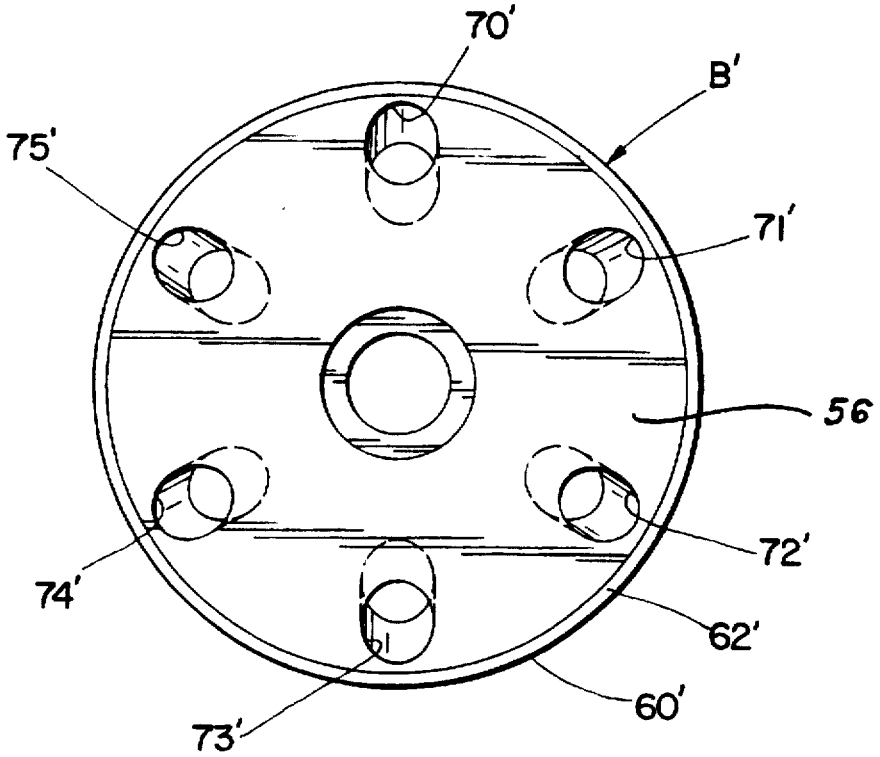
FIG. 7 is a front elevational view of the baffle of FIG. 6.

FIGS. 6 and 7 show another embodiment of a baffle B' having a downstream surface 56', an outer periphery 60' and a chamfer 62'. Hub 66' has a length slightly greater than the length of hub 66, and curved surface 68' is curved on a radius of ⅝ inch compared to a radius of ⅜ inch for curved surface 68.

Holes 70'–75' are inclined outwardly away from the longitudinal axis of baffle B'. In the arrangement shown, the longitudinal axis of each hole 70'–75' is inclined to the longitudinal axis of baffle B at an angle of about 30°. It will be recognized that this specific angle is not critical and can be varied. It is desirable that the streams flowing through holes 70'–75' intersect the outer cylindrical hollow stream in the vicinity of inlet end 90 of foam tube C. Inclined holes 70'–75' have their centers intersecting the plane of flat baffle surface 56' on the periphery of a circle having a diameter of 2.5 inches. The impact between the inner streams and the outer cylindrical hollow stream significantly increases turbulence within the foam tube for enhanced mixing of air with the solution of foam and water.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. In a nozzle having a foam tube and a stream divider for dividing a large volume liquid stream flowing toward said foam tube into a plurality of small volume liquid streams entering said foam tube, said plurality of small volume liquid streams including an outer hollow stream surrounding a plurality of spaced-apart inner streams, said foam tube having an entrance end, and air inlet passages outwardly of said outer hollow stream adjacent said entrance end through which air is aspirated into said foam tube.

2. The nozzle of claim 1 wherein said foam tube has a longitudinal axis and said air inlet passages extend substantially parallel to said axis.

3. In a nozzle including a foam tube having a foam tube passage with a circular inlet and outlet, a baffle within said nozzle for providing a hollow liquid stream flowing toward said circular inlet of said foam tube, and air inlet passages radially outwardly of said hollow liquid stream adjacent said circular inlet to said foam tube through which air is aspirated into said foam tube.

4. The nozzle of claim 3 wherein said foam tube has a longitudinal axis and said air inlet passages extend substantially parallel to said axis.

5. The nozzle of claim 3 wherein said circular inlet to said foam tube has an inlet diameter and said hollow liquid stream has an outer periphery that is spaced radially inwardly from said circular inlet.

6. A nozzle including a cylindrical flow passage having an outlet, a baffle positioned in said outlet for dividing a single stream flowing through said cylindrical flow passage into a plurality of smaller streams that include an outer hollow stream surrounding a plurality of spaced-apart inner streams, said cylindrical flow passage having a flow passage diameter, and said baffle having a circular outer periphery with a baffle diameter that is larger than said flow passage diameter.

7. In a nozzle having a foam tube and a stream divider for dividing a large volume liquid stream flowing toward said foam tube into a plurality of small volume liquid streams entering said foam tube, the improvement wherein said plurality of small volume liquid streams include an outer substantially cylindrical hollow stream surrounding a plurality of spaced-apart inner streams and at least one of said inner streams is outwardly inclined and intersects said outer substantially cylindrical hollow stream downstream of said stream divider within said foam tube.

8. In a nozzle having a foam tube and a stream divider for dividing a large volume liquid stream flowing toward said foam tube into a plurality of small volume liquid streams entering said foam tube, said plurality of small volume liquid streams including an outer substantially cylindrical hollow stream surrounding a plurality of spaced-apart inner streams, said foam tube having an outlet, said nozzle having an unobstructed discharge passage between said stream divider and said foam tube outlet, and air inlet passages radially outwardly of said hollow stream through which air is aspirated into said foam tube.

9. The nozzle of claim 8, wherein said large volume stream is cylindrical and has a stream diameter, said stream divider comprising a baffle having a circular outer periphery with a diameter larger than said stream diameter so that said hollow stream has both inner and outer diameters that are larger than said stream diameter.

10. In a nozzle having a foam tube and a stream divider for dividing a large volume liquid stream flowing toward said foam tube into a plurality of small volume liquid streams entering said foam tube, the improvement wherein said plurality of small volume liquid streams include an individual outer hollow stream surrounding a plurality of spaced-apart individual inner streams and at least one of said inner streams is outwardly inclined and intersects said individual outer hollow stream downstream of said stream divider.

11. In a nozzle having a foam tube and a stream divider for dividing a large volume liquid stream flowing toward said foam tube into a plurality of small volume liquid streams entering said foam tube, said plurality of small volume liquid streams including an individual outer hollow stream surrounding a plurality of spaced-apart individual inner streams, said large volume liquid stream being substantially cylindrical and having a large stream diameter, said individual outer hollow stream being substantially cylindrical and having both inner and outer diameters that are substantially larger than said large stream diameter.

12. In a nozzle having a foam tube and a stream divider for dividing a large volume liquid stream flowing toward said foam tube into a plurality of small volume liquid streams entering said foam tube, said plurality of small volume liquid streams including an individual outer hollow stream surrounding a plurality of spaced-apart individual inner streams, said stream divider comprising a baffle having an upstream side facing away from said foam tube, said baffle having an elongated central hub on said upstream side thereof and having an outer periphery, and said upstream side of said baffle having an upstream surface that is smoothly concavely curved along at least a portion of said elongated central hub and outwardly toward said outer periphery.

13. In a nozzle having a foam tube and a stream divider for dividing a large volume liquid stream flowing toward said foam tube into a plurality of small volume liquid streams entering said foam tube, the improvement wherein said plurality of small volume liquid streams include an individual outer hollow stream surrounding a plurality of spaced-apart individual inner streams, said foam tube having a foam tube passage with substantially circular entrance and exit end portions that have entrance and exit end portion diameters, and said individual outer hollow stream being substantially cylindrical and having an outer diameter that is smaller than said entrance end portion diameter.

14. The nozzle of claim 13 wherein said exit end portion diameter is smaller than said entrance end portion diameter and said foam tube passage gradually converges smoothly from said substantially circular entrance end portion toward said substantially circular exit end portion.

15. In a nozzle including a foam tube having a foam tube passage with a circular inlet and outlet, a baffle within said nozzle for providing an individual cylindrical hollow liquid stream flowing toward said circular inlet of said foam tube, said circular inlet of said foam tube having an inlet diameter, and said individual cylindrical hollow liquid stream having an outer diameter that is substantially smaller than said inlet diameter.

16. In a nozzle including a foam tube having a foam tube passage with a circular inlet and outlet, a baffle within said nozzle for providing an individual cylindrical hollow liquid stream flowing toward said circular inlet of said foam tube, said baffle having a plurality of spaced-apart holes therethrough for providing a plurality of individual inner streams flowing inwardly of said individual cylindrical hollow liquid stream toward said foam tube inlet, said baffle having upstream and downstream sides and a baffle longitudinal axis, and at least one of said holes being inclined outwardly away from said baffle longitudinal axis in a direction from said upstream side toward said downstream side so that said individual inner stream flowing through said one of said holes intersects said individual cylindrical hollow liquid stream downstream of said baffle.

17. The nozzle of claim 16 wherein all of said holes are inclined at angles that provide intersection of all of said individual inner streams with said individual cylindrical hollow liquid stream in the vicinity of said foam tube inlet.

18. In a nozzle including a foam tube having a foam tube passage with a circular inlet and outlet, a baffle within said nozzle for providing an individual cylindrical hollow liquid stream flowing toward said circular inlet of said foam tube, said nozzle having a substantially cylindrical flow passage with a predetermined diameter and said individual cylindrical hollow liquid stream having both inner and outer diameters that are substantially greater than said predetermined diameter.

19. A nozzle including a cylindrical flow passage having an outlet, a baffle positioned in said outlet for dividing a single stream flowing through said cylindrical flow passage into a plurality of smaller streams that include an individual outer hollow cylindrical stream surrounding a plurality of spaced-apart individual inner streams, said cylindrical flow passage having a flow passage diameter and said flow passage flaring outwardly adjacent said outlet, and said baffle being circular and having a baffle diameter that is greater than said flow passage diameter.

20. A nozzle including a cylindrical flow passage having an outlet, a baffle positioned in said outlet for dividing a single stream flowing through said cylindrical flow passage into a plurality of smaller streams that include an individual outer hollow cylindrical stream surrounding a plurality of spaced-apart individual inner streams, a plurality of said individual inner streams being outwardly inclined and intersecting said individual outer hollow cylindrical stream of said baffle.

* * * * *

UNITED STATES PATENT AND TRADEMARK OFFICE

CERTIFICATE OF CORRECTION

PATENT NO. : 5,775,596

DATED : July 7, 1998

INVENTOR(S) : Daniel Bruce Whisman & Kevin James Petit

It is certified that error appears in the above-indentified patent and that said Letters Patent is hereby corrected as shown below:

Column 8, Line 43 (next to last line of Claim 20), after "stream" insert --- downstream --- so that the line reads as follows: secting said individual outer hollow cylindrical stream downstream of Signed and Sealed this First Day of September, 1998

*Attest:*

*Attesting Officer*

BRUCE LEHMAN

*Commissioner of Patents and Trademarks*